128-24 A AU 337 EX
9/30/86 OR 4,614,178

United States Patent [19]
Harlt et al.

[11] Patent Number: 4,614,178
[45] Date of Patent: Sep. 30, 1986

[54] AUTOMATIC DOSE METER AND CONTROL CIRCUIT ARRANGEMENT

[75] Inventors: János Harlt; László Hancz, both of Budapest, Hungary

[73] Assignee: Orvosi Muszerszovetkezet, Hungary

[21] Appl. No.: 750,983

[22] PCT Filed: May 6, 1981

[86] PCT No.: PCT/HU81/00019

§ 371 Date: Jan. 5, 1983

§ 102(e) Date: Jan. 5, 1983

[87] PCT Pub. No.: WO82/03779

PCT Pub. Date: Nov. 11, 1982

Related U.S. Application Data

[63] Continuation of Ser. No. 459,574, Jan. 5, 1983, abandoned.

[51] Int. Cl.[4] ..... A61H 1/00
[52] U.S. Cl. ..... 128/24 A
[58] Field of Search ..... 128/804, 660, 661, 24 A, 128/303 A, 22, 684

[56] References Cited

U.S. PATENT DOCUMENTS 4,315,514 2/1982 Drewes et al. ..... 128/660
4,390,026 6/1983 Christman ..... 128/660
4,432,236 2/1984 Nagasaki ..... 128/660

FOREIGN PATENT DOCUMENTS 0238616 3/1969 U.S.S.R. .
0562279 6/1977 U.S.S.R. .
0578065 10/1977 U.S.S.R. .
0774548 10/1980 U.S.S.R. .
0822833 4/1981 U.S.S.R. .

*Primary Examiner*—William E. Kamm
*Assistant Examiner*—David Shay
*Attorney, Agent, or Firm*—Handal & Morofsky

[57] ABSTRACT

An automatic dose meter and control circuit arrangement of switching and of analog modes of operation, especially for ultrasonic therapeutic apparatus. The efficiency of ultrasonic therapy depends to a great extent on the dose received by the patient. The essence of the invention lines in that a signal proportional to the dose get by the patient is generated and processed, and the operation of an ultrasonic generator feeding the treatment head is controlled with this signal. The duration of the treatment is determined in the function of the dose get by the patient, in this way the dose will always be equal to the predetermined value. The automatic dose meter and control circuit arrangement can be realized in two different types: analog mode of operation and switching mode of operation.

6 Claims, 10 Drawing Figures

AUTOMATIC DOSE METER AND CONTROL CIRCUIT ARRANGEMENT

This application is a continuation of application Ser. No. 459,574, filed Jan. 5, 1983, now abandoned.

TECHNICAL FIELD

This invention relates to an automatic dose meter and control circuit arrangement, especially for ultrasonic therapeutic apparatus.

BACKGROUND ART

Ultrasonic therapy is a well known and applied method in the area of physiotherapy.

During ultrasonic therapy ultrasonic energy is transmitted by means of a treatment head to the part of the body to be treated and its biological effect depends on the quantity of the ultrasonic energy transmitted to the patient's body. The ultrasonic energy exerts its health-giving effect in the body in two ways: directly influences the irradiated organ, on one hand in the form of mechanical and heating effects, on the other hand indirectly, i.e. transmitted by the sympathetic system. The ultrasonic therapy can be applied especially advantageously in the cases of rheumatological diseases, spinal complaints and in certain types of inflammations.

The efficiency of ultrasonic therapy depends to a great extent on the dose received by the patient. In order to ensure that the ultrasonic vibrations generated by the treatment head can penetrate into the patient's body, an appropriate coupling medium should be provided between the patient's body and the treatment head containing a piezo-electric converter. In the case, when the coupling between the patient's body and the treatment head is inappropriate, the efficiency of the treatment will decrease and the treatment itself becomes less reproducible. An inappropriate coupling can result from a coupling medium of low ultrasonic conductivity, from a low quantity of the coupling medium, from air bubbles in the coupling medium and the uneveness of the surface of the human body.

In the course of the treatment a continuously optimal coupling can not be guaranteed between the patient's body and the treatment head. This means that the intensity of ultrasonic energy $I_k$ measured on the body of the patient (ultrasonic energy pro surface unit, $W/cm^2$) will not always be equal to the intensity of the ultrasonic energy measured on the treatment head. As a consequence, the patient will not get the predetermined dose. Hence the coupling factor can vary within broad limits and, in the known apparatus, there is no treatment time correction, the patient gets only a part of the necessary dose. Such known apparatus are made by the firms, as follows:

Mettler Electronis (USA): "Sonicator II"
"Burdick UT 4300"
Siemens Ag. (Germany): "Sonodinator"
ERBE (Germany): "Erbosonat"
OMSZÖV (Hungary): "Ultron T"

(The last firm is identical with the assignee of applicant.)

OBJECT OF THE INVENTION

The object of the present invention is to provide an apparatus, especially for ultrasonic therapy, by determining which of the doses received by the patient's body is approximately equal to the predetermined dose and wherein the volume of the received dose can be controlled, whereby the difficulties and drawbacks previously described can be eliminated.

DISCLOSURE OF THE INVENTION

Accordingly, the invention provides an automatic dose meter and control circuit therefor, comprising an ultrasonic generator, a power control circuit and a timer circuit connected to the inputs thereof, a detector circuit, a divider circuit and a treatment head connected to the outputs of the ultrasonic generator, a clock generator connected to the output of a control circuit, wherein the input of the power control circuit is connected to an other output of the control circuit.

In accordance with an aspect of the present invention, the task is solved in such a manner that the output of the ultrasonic generator providing an output signal proportional to the change in intensity on the patient side is connected by means of the detector circuit with an input of a difference circuit, the other output thereof providing an output signal proportional to the intensity of the ultrasonic signal measured on the treatment head is connected by means of the divider circuit to the other input of the difference circuit and to the input of a second divider circuit; the output of the difference circuit is connected to the input of the control circuit, and wherein the output of the second divider is connected to the other input of the control circuit, the output of this control circuit is connected with the clock generator. As another aspect of the present invention, the output of the second divider circuit is connected to the input of a third divider circuit, the output of the third divider circuit is connected to the input of a comparator circuit, wherein the second input of said comparator circuit is connected with the output of the difference circuit and the output thereof is connected to an indicator lamp.

It is also advantageous, when the output of the comparator circuit is connected to the input of a delay circuit, the output of which is connected to an input of the ultrasonic generator. The output of the difference circuit is connected via an integrator circuit to an input of the control circuit.

A further object of the present invention is to provide a solution, by means of which the drawbacks of the known apparatus can be eliminated in that the apparatus described above can be used in switching mode of operation.

In accordance with the present invention, this latter task is solved in such a manner that the output of the ultrasonic generator providing an output signal proportional to the change in intensity of the ultrasonic signal measured on the patient side is connected by means of the detector circuit with the input of a comparator circuit, whereby the other output thereof providing an output signal proportional to the intensity of the ultrasonic signal measured on the treatment head is connected by means of the divider circuit to the other input of the comparator circuit, the output of which is connected to the input of the clock generator and to the input of an indicator lamp.

Preferably, the output of the comparator circuit is connected to the input of a delay circuit, the output of which is connected to one of the inputs of the ultrasonic generator, and the output of the comparator circuit is connected via a control circuit to the input of the clock generator and to the input of a power control circuit.

BRIEF DESCRIPTION OF DRAWINGS

The invention will be explained in detail by way of example only, with reference to preferred embodiments illustrated in the accompanying drawings, wherein.

DESCRIPTION OF THE PREFERRED EMBODIMENTS

Figure 3:
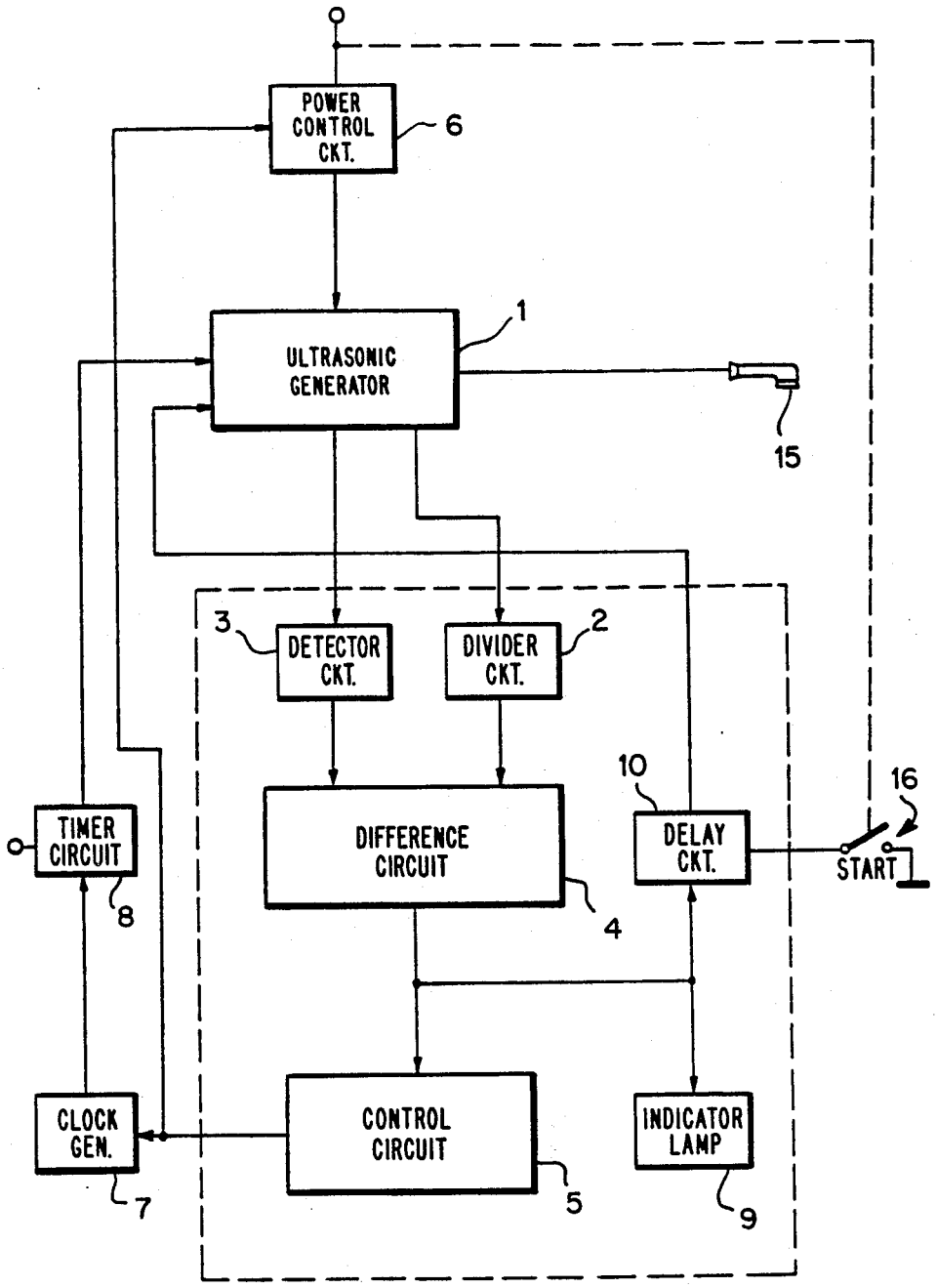
FIG. 3 is a block diagram of an automatic dose meter and control apparatus of the type employing switching mode of operation.

Referring now to FIG. 3 showing a block diagram of the automatic dose meter and control apparatus according to the present invention, a treatment head 15 is connected to the output of an ultrasonic generator 1, the inputs of which are connected with the outputs of a timer circuit 8 and a power control circuit 6. The outputs of said ultrasonic generator 1 are connected to the inputs of a divider circuit 2 and a detector circuit 3, the outputs of which are connected to the inputs of a difference circuit 4. A control circuit 5, a delay circuit 10 and an indicator lamp 9 are connected to the output of said difference circuit 4. The output of said control circuit 5 is connected to a clock generator 7 and to the input of said power control circuit 6, whereby the output of said clock generator 7 is connected to said timer circuit 8. The output of said delay circuit 10 is connected to the third input of said ultrasonic generator 1.

The automatic dose meter and control apparatus described above operates in the switching mode, as follows.

Figure 4:
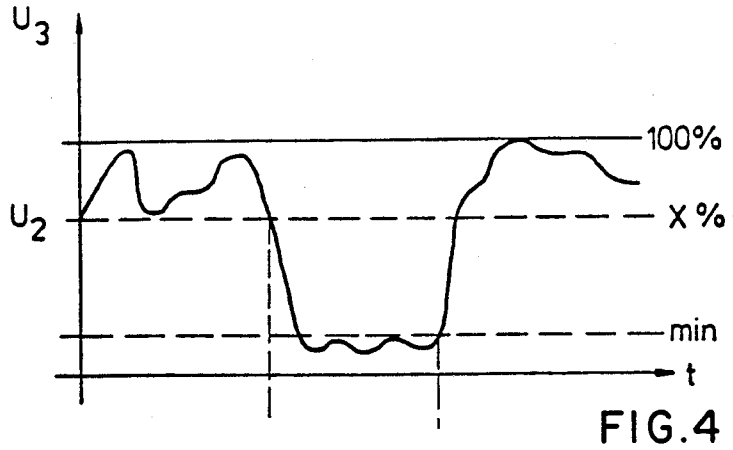
FIG. 4 is a diagram showing the output of voltage of the treatment head of the apparatus of the type employing switching mode of operation.
Figure 5:
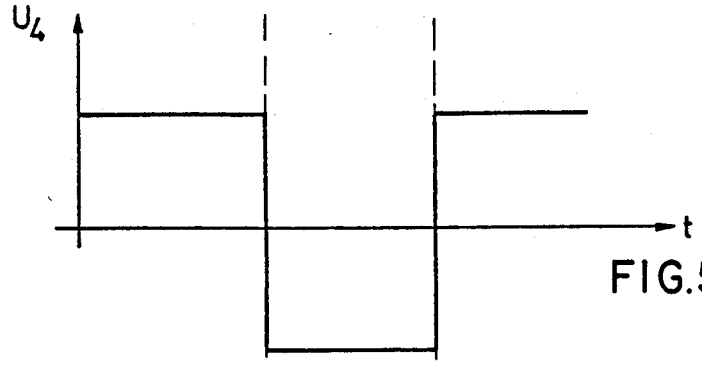
FIG. 5 shows the output voltage of the comparator circuit of the apparatus in FIG. 3.
Figure 6:
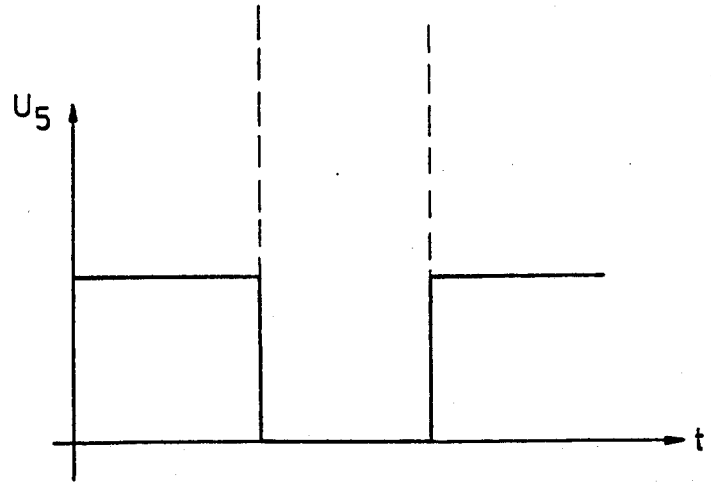
FIG. 6 similar to FIG. 5, only the base level is shifted upwards.
Figure 7:
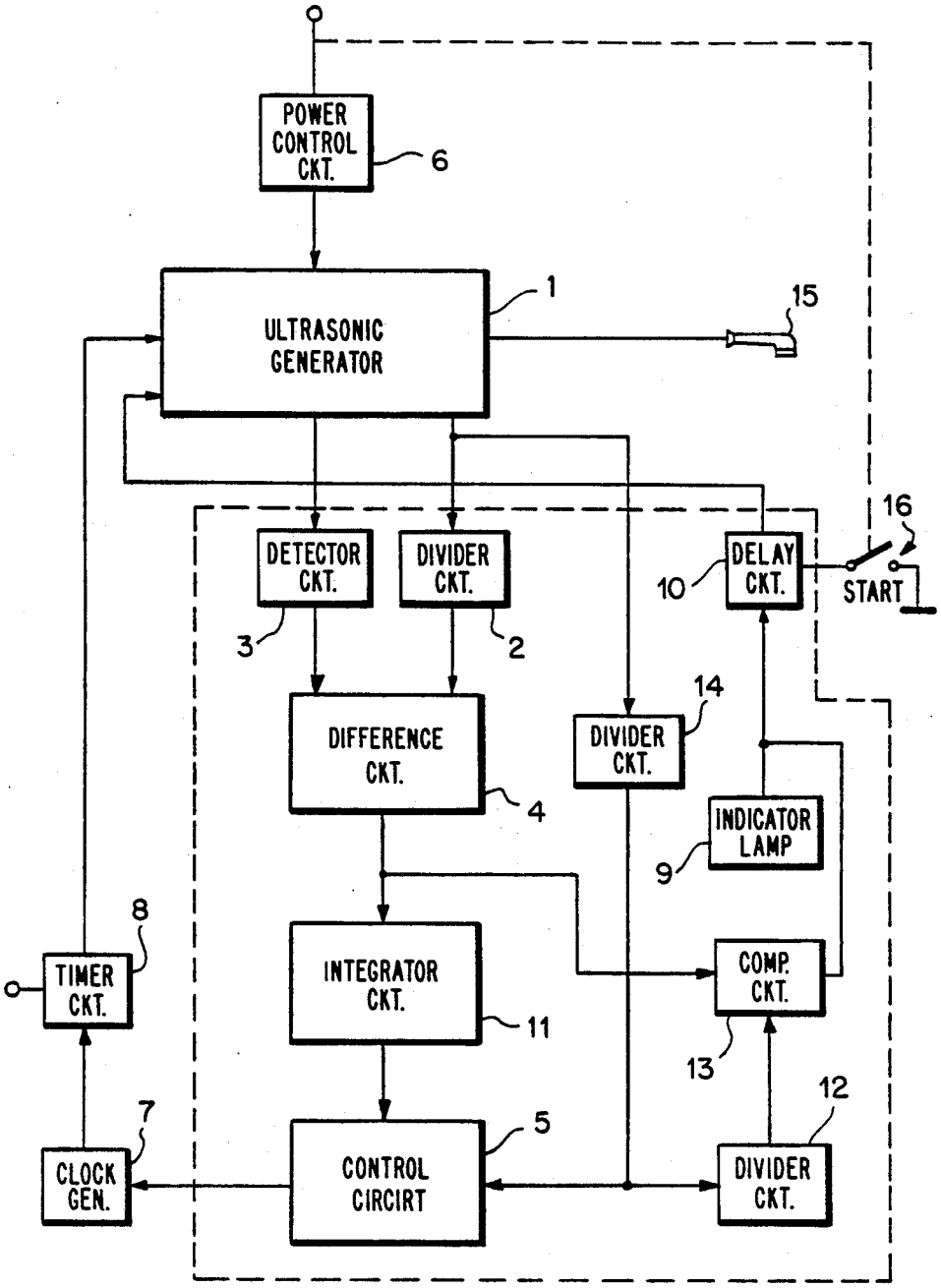
FIG. 7 is a block diagram of an automatic dose meter and control apparatus according to the invention, of the type employing analoge mode of operation.

The detector circuit 3 receives an output signal of the ultrasonic generator 1 proportional to the loading (i.e. the treatment head 15), and provides an output signal which is proportional to the change in intensity of the ultrasonic energy measured on the patient side. This signal contains furthermore a component as well, which results from the losses of the ultrasonic generator 1 and of the treatment head 15, therefore the signal corresponding to the uncoupled state is not zero. The divider circuit 2 divides the output signal of the ultrasonic generator 1, which is proportional to the intensity of the ultrasonic energy measured on the treatment head 15, so that the state of the output signal of the difference circuit 4 is changed at a given percentage X of the coupling. By changing the dividing ratio, the change of state of the difference circuit 4 can be carried out by any value of the coupling. This is illustrated in FIGS. 4 and 5, where U2, U3 and U4 designate the output signals of the divider circuit 2, the detector circuit 3 and of the difference circuit 4 as well. The output signal of the difference circuit 4 controls the control circuit 5, the output signal U5 of which is shown in FIG. 6. The output signal U5 controls the clock generator 7 and the power control circuit 6 as well: under a predetermined value of the coupling, it inhibits or disables the measurement of the duration of the treatment and sets the ultrasonic intensity of the treatment head 15 via the power control circuit to a predetermined minimal value. This minimal value of ultrasonic intensity of the treatment head 15 is determined so that the detector circuit 3 and the difference circuit 4 should be able to process the changes of the electric characteristics of the ultrasonic generator 1 resulting from the effects of the loading, that is, above the minimal value, the output state of the difference circuit 4 should change. In this latter case the control circuit 5 enables the measurement of the duration of the treatment, and at the same time it resets the ultrasonic intensity of the treatment head to the value set in the beginning. The timer circuit 8 stops the ultrasonic generator 1 at the end of the duration of the treatment, and the ultrasonic generator 1 will generate a treatment signal only after a following start of the treatment or the intensity. The indicator lamp 9 shows the effective time of treatment, i.e. if the value of the coupling lies above said predetermined minimal value. The delay circuit 10 is started by closing the contacts of a switch 16 (see FIG. 3) and a delay time of about 20 secs is started. If during this delay time the treatment is not started or the coupling does not reach the predetermined minimal value at least once, then said delay circuit 10 disables the ultrasonic generator 1 at the end of this delay time, and on the treatment head 15 no ultrasonic signal appears. If the coupling is equal or greater than the predetermined minimal value, the state of the output signal of the difference circuit 4 changes and enables the delay circuit 10, until the value of the coupling becomes smaller than this minimal value, or the treatment time period is over. Turning now to FIG. 7, a block diagram of an other preferred embodiment of the automatic dose meter and control apparatus is shown, which apparatus operates in analog mode. Here a treatment head 15 is connected to the output of an ultrasonic generator 1, the inputs of which are connected with the outputs of a timer circuit 8 and a power control circuit 6. The outputs of the ultrasonic generator 1 are connected to the inputs of a divider circuit 2 and a detector circuit 3, the outputs of which are connected to the inputs of a difference circuit 4. An integrator circuit 11 and a comparator circuit 13 are connected to the output of the difference circuit 4. The output of said integrator circuit 11 is connected to an input of a control circuit 5, the output of which is connected to a clock generator 7. The output of the clock generator 7 is connected to an input of the timer circuit 8. The output of the ultrasonic generator 1 connected to the input of the divider circuit 2 is connected to the input of a second divider circuit 14, the output of which is connected to the inputs of the control circuit 5 and a third divider circuit 12. The output of the divider circuit 12 is connected to a second input of the comparator circuit 13, the output of which is connected to an indicator lamp 9 and to the input of a delay circuit 10. The output of the delay circuit 10 is connected to a third input of the ultrasonic generator 1.

The automatic dose meter and control apparatus described above operates in analog mode, as follows.

The detector circuit 3 receives an output signal of the ultrasonic generator 1 proportional to the loading (i.e. the intensity of ultrasonic energy measured on the body of the patient).

The ultrasonic generator 1 provides an output signal proportional to the intensity of ultrasonic energy measured on the treatment head 15, and this signal is divided on the divider circuit 2 so that its output signal should be equal to the output signal of the detector circuit in the case, when there is no coupling between the treatment head 15 and the patient's body.

In this case the output signal of the difference circuit 4 is proportional to the intensity of ultrasonic energy measured on the patient's body.

This signal is then integrated by the integrator circuit 11, which means that the output signal of the integrator circuit 11 is proportional to the dose received by the patient during the treatment period. The output signal of the integrator circuit 11 is fed to one input of the control circuit 5, the other input of which is fed by the output signal of the ultrasonic generator 1 which is proportional to the intensity of ultrasonic energy measured on the treatment head 15. This signal is not applied directly onto the input of the control circuit 5, but by means of the divider circuit 14, the dividing ratio of which is set so that the signal appearing on its output should be equal to the output signal of the difference circuit 4, when there is full coupling (100%).

The two input signals are compared by the control circuit 5 which provides a control signal proportional to the difference for the base oscillator of the clock generator 7. The output signal of the control circuit 5 is independent from the intensity of ultrasonic energy, it depends solely on the coupling. It can be seen that in this way the patient will receive the predetermined dose with a high accuracy and independently from the coupling.

Figure 8:
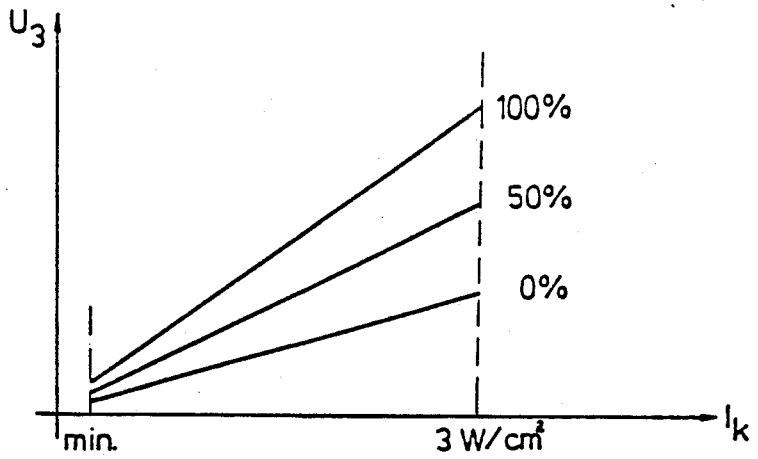
FIG. 8 shows the output voltage of the ultrasonic generator of the apparatus as a function of ultrasonic intensity measured on the patient.
Figure 9:
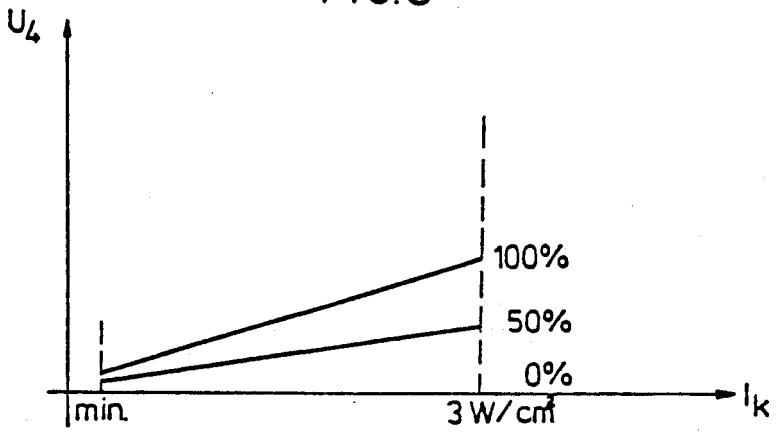
FIG. 9 shows the output voltage of the difference circuit of the apparatus as a function of ultrasonic intensity measured on the patient; and finally
Figure 10:
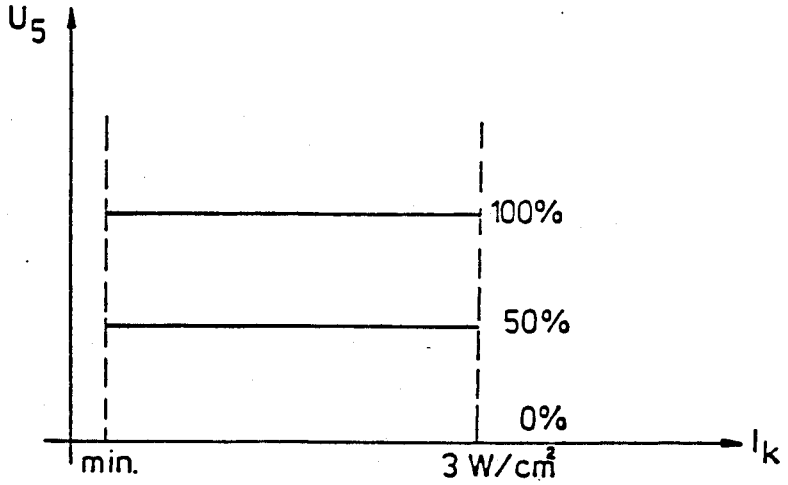
FIG. 10 shows the output signal of the control circuit of the apparatus as a function of ultrasonic intensity.

The output signals U3, U4 and U5 of the detector circuit 3, the difference circuit 4 and the control circuit 5 are shown in FIGS. 8, 9 and 10, as a function of the intensity of ultrasonic energy $I_k$.

The inputs of said comparator circuit 13 are fed by a signal proportional to the intensity of ultrasonic energy measured on the patient's body and a divided value of the signal proportional to the intensity of ultrasonic energy measured on the patient's body for full coupling (100%). The state of the comparator's output changes at a predetermined value of the coupling, and this value can be set by means of varying the dividing ratio of the divider circuit 12. The output signal of the comparator circuit 13 controls the indicator lamp 9 and the delay circuit 10, as described in connection with the automatic dose meter of switching mode.

Figure 1:
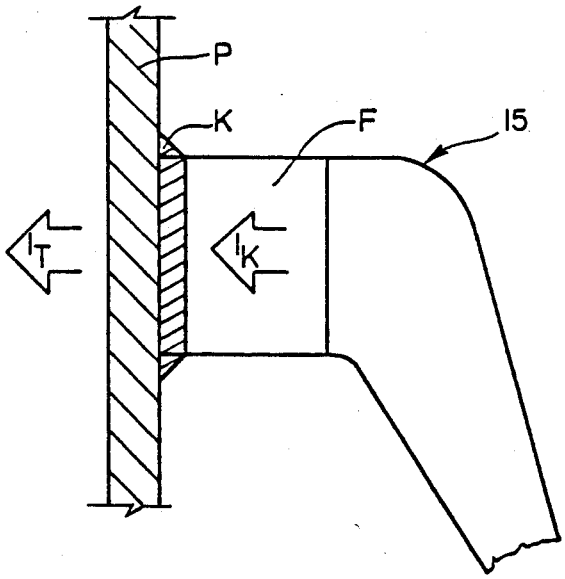
FIG. 1 illustrates schematically the surface of the patient's body and the treatment head attached thereto.
Figure 2:
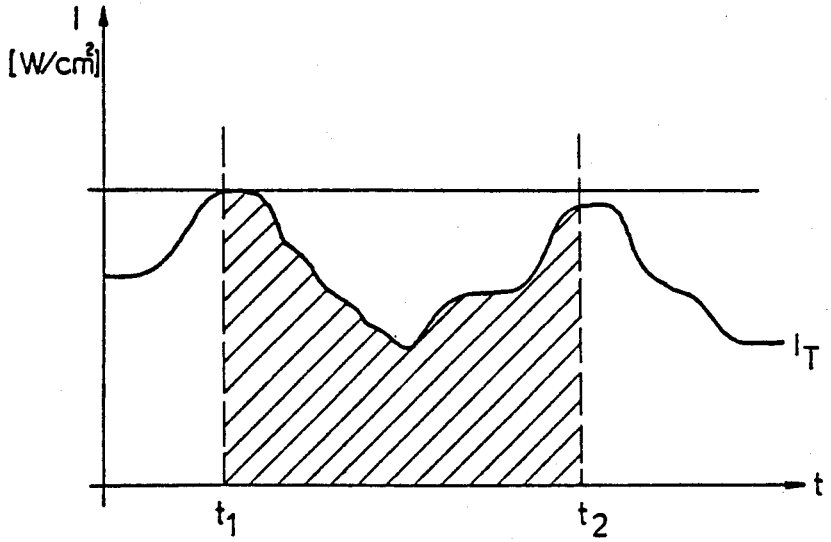
FIG. 2 shows the change in intensity as a function of time.

For the sake of better understanding, FIG. 1 shows schematically the patient's body P, the treatment head 15 and a coupling medium K therebetween, where $I_k$ means the intensity of ultrasonic energy measured on the treatment head 15 and $I_T$ the intensity of ultrasonic energy measured on the body of the patient. FIG. 2 shows the intensity of ultrasonic energy as a function of time t. It is clear that the dose received by the patient during the treatment period between the time points t1 and t2 can be expressed as follows:

$$D = \int_{t1}^{t2} I_k \, dt \left[ \frac{W \sec}{m^2} \right]$$

where D=dose.

It is noted that the circuits 1–14 and switch 16 are all conventional as widely used in the electronic field and known to the expert in the field by their names as used in the present specification, therefore, in order to avoid unnecessarily crowding the specification, their details have been omitted.

Thus, it is seen that there has been provided a means for readily and simply providing an automatic ultrasonic dose meter which in an expeditious manner assures that the predetermined is delivered to the patient under treatment and such is readily and inexpensively achieved.

While there have been shown and described what are at present considered to be the preferred embodiments of the present invention, modifications thereto will readily occur to those skilled in the art. For example, other forms of rendering the dose sensing and controlling means effective, such as other than the conventional circuits, could be used with the same end results. It is not desired, therefore, that the invention be limited to the specific circuit shown and described and it is intended to cover in the appended claims all such modifications as fall within the true spirit and scope of the invention.

What we claim is:

1. An automatic dose meter and control circuit for switching mode of operation, and for use with an ultrasonic therapeutic apparatus including a treatment head (15), an ultrasonic generator (1) for generating ultrasonic energy for said treatment head and comprising a plurality of inputs and a plurality of outputs, said treatment head being connected to one of said outputs of said ultrasonic generator, another one of said outputs delivering a signal proportional to the change in the intensity of the ultrasonic energy delivered by the treatment head to a patient's body, a power control circuit (6) for controlling the level of ultrasonic energy generated by said ultrasonic generator and having and input and an output; said output of said power control circuit is connected to one of said inputs of said ultrasonic generator, a detector circuit (3) having an input and an output, said input of said detector circuit receiving said output signal proportional to the change in the intensity of the ultrasonic energy delivered to the patient of the ultrasonic generator from said another output thereof, said detector circuit providing at said output thereof an output signal proportional to the intensity of the ultrasonic energy delivered to the patient's body, a divider circuit (2) having an input and an output, said input of said divider circuit receiving and dividing the output signal proportional to the change in the intensity of the ultrasonic energy delivered to the patient of said ultrasonic generator and providing at said output thereof an output signal equal in magnitude to the output signal of the detector circuit in the absence of coupling between the treatment head and the patient's body, a control circuit (5) comprising an input and output, the input of said power control circuit is connected to the output of said control circuit, a difference circuit (4) comprising a pair of inputs and an output, said output signal of said ultrasonic generator (1) being coupled via said detector circuit (3) to an input of said difference circuit (4), another of the outputs of said ultrasonic generator (1) providing an output signal proportional to the intensity of the ultrasonic energy measured on the patient's body is connected via said divider circuit (2) to another input of said difference circuit (4), the outputs of said detector circuit and said divider circuit are coupled to the input of said control circuit (5), the output of said difference circuit (4) is connected to the input of said control circuit (5), said control circuit outputting a signal for controlling said power control circuit and, thereby said ultrasonic generator solely as a function of compling between said treatment head and the patient's body.

2. An automatic does meter and control circuit as claimed in claim 1, further comprising a delay circuit (10) having input and output, the output of said difference circuit (4) is connected to the input of said delay circuit (10), the output of said delay circuit (10) is connected to one of the inputs of said ultrasonic generator (1), said delay circuit disabling the ultrasonic generator in the absence of a predetermined minimum value of ultrasonic energy delivered to the patient's body.

3. An automatic dose meter and control circuit for analog mode of operation, and for use with an ultrasonic therapeutic apparatus including a treatment head (15), an ultrasonic generator (1) for generating ultrasonic energy for said treatment head and comprising a plurality of inputs and a plurality of outputs, said treatment head being connected to one of said outputs of said ultrasonic generator, another one of said outputs delivering a signal proportional to the intensity of the ultrasonic energy delivered by the treatment head to a patient's body, a power control circuit (6) for controlling the level of ultrasonic energy generated by said ultrasonic generator and having an input and an output, said output of said power control circuit is connected to one of said inputs of said ultrasonic generator, a detector circuit (3) having an input and an output, said input of said detector circuit receiving said output signal proportional to the change in the intensity of the ultrasonic energy delivered to the patient of the ultrasonic generator from said another output thereof, said detector circuit providing at said output thereof an output signal proportional to the change in intensity of the ultrasonic energy delivered to the patient's body, a first divider circuit (2) having an input and an output, said input of said first divider circuit receiving and dividing the output signal proportional to the change in the intensity of the ultrasonic energy delivered to the patient of said ultrasonic generator and providing at said output thereof an output signal equal in magnitude to the output signal of the detector circuit in the absence of coupling between the treatment head and the patient's body, a control circuit (5) comprising two inputs and an output, a difference circuit (4) comprising a pair of inputs and an output, said signal proportional to the change in intensity of the ultrasonic energy measured at the patient's body is coupled via said detector circuit (3) to one of said inputs of said difference circuit (4); another of the outputs of said ultrasonic generator (1) providing an output signal porportional to the intensity of the ultrasonic energy measured at the treatment head (15) is coupled via said first divider circuit (2) to another input of said difference circuit, a second divider circuit (14) comprising input and output means, said another output of said ultrasonic generator being connected to the input means of said second divider circuit (14); and the output of said second divider circuit (14) is connected to the input of said control circuit (5) and delivering an output signal equal in magnitude to the output signal of the difference circuit in the presence of full coupling, the output of said difference circuit (4) outputting a signal representing a predetermined ratio of coupling, said output signal of said difference circuit being connected to the input of said control circuit (5), said control circuit comparing the output signal of said difference circuit (4) and of said second divider circuit (14) and delivers a control signal proportional either to the difference or solely to the coupling for controlling the power level of said ultrasonic generator.

4. An automatic dose meter and control circuit as claimed in claim 3, further including a third divider circuit (12) and a comparator circuit (13) having a first and second input and an output, the output of said second divider circuit (14) is connected to the input of said third divider circuit (12) for delivering said signal equal in magnitude to the output signal of said difference circuit in the presence of full coupling, the output of said third divider circuit (12) is connected to the input of said comparator circuit (13), wherein the second input of said comparator circuit is connected to the output of said difference circuit (4) and the output of said comparator circuit (13) is connected to an indicator lamp (9) for indicating the state of the coupling between said treatment head and the patient's body.

5. An automatic dose meter and control circuit arrangement as claimed in claim 3 further comprising a delay circuit (10) having an input and an output; the output of said delay circuit (13) is connected to the input of said delay circuit (10), the output of said comparator circuit is connected to an input of said ultrasonic generator (1), said delay circuit disabling the ultrasonic generator in the absence of a predetermined minimum value of ultrasonic energy delivered to the patient.

6. An automatic dose meter and control circuit arrangement as claimed in claim 3, wherein the output of said difference circuit (4) is connected to an integrator circuit (11), the output of said integrator circuit connected to said control circuit and delivering an output signal proportional to the dose received by the patient to the input of said control circuit (5).

* * * * *

UNITED STATES PATENT AND TRADEMARK OFFICE

CERTIFICATE OF CORRECTION

PATENT NO. : 4,614,178

DATED : Sept. 30, 1986

INVENTOR(S) : Hartl, et al

It is certified that error appears in the above-identified patent and that said Letters Patent is hereby corrected as shown below:

On the title page (Item 19), "Harlt et al" should read -- Hartl et al --.

On the title page inventors should read

-- (75) Inventors: Janos Hartl, Laszlo Hancz, both of Budapest, Hungary --.

Signed and Sealed this

Third Day of March, 1987

*Attest:*

*Attesting Officer*

DONALD J. QUIGG

*Commissioner of Patents and Trademarks*